United States Patent [19]

Piatscheck et al.

[11] 4,164,907

[45] Aug. 21, 1979

[54] DEVICE FOR STORING VALUABLES

[76] Inventors: Michael Piatscheck, Eilenau 49, 2 Hamburg 76; Dieter Sievers, Bernadottestr. 199, 2 Hamburg 52, both of Fed. Rep. of Germany 7834

[21] Appl. No.: 863,975

[22] Filed: Dec. 23, 1977

[30] Foreign Application Priority Data

Dec. 24, 1976 [DE] Fed. Rep. of Germany ..... 2658920

[51] Int. Cl.[2] ..... E05G 1/08

[52] U.S. Cl. ..... 109/50; 109/56

[58] Field of Search ..... 109/50, 51, 52, 53, 109/56; 52/298, 704; 232/39; 248/156; 312/254

[56] References Cited

U.S. PATENT DOCUMENTS

| | | | |
|---|---|---|---|
| 838,194 | 12/1906 | Larsh | 232/39 X |
| 1,679,791 | 8/1928 | Silberhartz | 312/254 X |
| 1,991,087 | 2/1935 | Falcon | 52/298 X |
| 3,219,195 | 11/1965 | Mize | 248/156 X |
| 3,710,736 | 1/1973 | Biondi et al. | 109/50 |

*Primary Examiner*—Mervin Stein
*Assistant Examiner*—David H. Corbin
*Attorney, Agent, or Firm*—Allison C. Collard; Thomas M. Galgano

[57] ABSTRACT

A device for storing valuables includes a multiplicity of safety deposit boxes arranged in a transportable and releasably-anchorable column, a hollow receiving jacket anchorable in a ground support, and means for releasably anchoring the column in the receiving jacket. The column consists of a plurality of sets of vertically-superimposed safety deposit boxes, disposed adjacent to one another with the sets being disposed side-by-side in a generally circular arrangement.

6 Claims, 2 Drawing Figures

DEVICE FOR STORING VALUABLES

The present invention relates to a device for storing valuables.

It is known to provide devices for storing valuables in safe deposit boxes which are fixedly installed into the walls of a building, or which are moveably mounted therein. For keeping valuables safe, it is known to store valuables in a movable type of box, as well as to store the same in stationary safe deposit boxes. Such stationary or fixed safe deposit boxes are predominantly present in banks, or in railroad stations, and are embedded into the walls of the buildings, or they are fixedly installed in long rows, particularly, in railroad stations. Transporting and reerecting such deposit boxes at other places is only possible, if at all, after time-consuming and correspondingly cumbersome undertakings.

The aforementioned devices for keeping and storing valuables are exclusively suitable for installation within closed buildings which, in this case, include railroad stations. However, there seems to be a need for storing valuables at places which are suited for recreation, for example, beaches, outdoor swimming pools, camping areas, sport arenas, and the like. These places are particularly prone to thefts, since the valuables for persons who swim or partake in sports leave their valuables behind for a short time without being supervised. In addition, there seems to be a need for a storing facility for valuables in changing rooms of any type, for example, in exercising halls or swimming pools, or even at places of work. The need for such storage devices were solved to a certain extent by providing stationary safe deposit boxes. However, in all cases it requires very expensive construction measures.

It is, therefore, an object of the present invention to provide a device for storing valuables which can be universally used within closed buildings as well as in open spaces, for example, at beaches, open-air swimming pools, camping areas, and the like, without requiring expensive structural means at the place of installation.

This object of the invention is obtained by a device for storing valuables having a plurality of adjacent and vertically superimposed safe deposit boxes, which safe deposit boxes are fixedly installed in a round or multicornered column which is transportable, and which has a lower end which is provided with a device for anchoring the column.

In accordance with the invention a plurality of safe deposit boxes are provided in a transportable column which is easy to handle and can be easily installed at a desired place. In order to place the safety deposit column at a desired location, it is only required that a corresponding anchoring means is provided for anchoring the end of the column at the desired location. It is naturally essential to provide a safe anchoring of the column at the desired location, so as to prevent a stealing of the column. However, the structural requirements are very low as will be discussed a little later.

The inventive safe deposit box for storing valuables is especially advantageous in that it is universally usable without requiring special adjustments to the intended sites. This naturally leaves room for many structural variations. For example, the same device may be placed in closed rooms as well as in open spaces. The range of application extends from placing the device at beaches to an installation in changing rooms in factories, in order to eliminate expensive fixedly arranged safe deposit boxes. The inventive device can be easily transported to the installation site and can be easily anchored to the ground with a corresponding anchoring means. By removing the anchoring means from the safe deposit column, the column can be easily moved to another desirable site. At the same time while the column is anchored at a given site, it is protected from stealing, or unauthorized dismantling. Furthermore, the column type device is advantageous in that it only requires a small space and in that the safety deposit boxes are easily accessible. The column also provides an aesthetically-pleasing construction and is not considered to be bothersome in free open spaces.

In a further embodiment of the invention, the device is provided with a elongated support element around which the safe deposit boxes are arranged; the lower portion of the support element is encompassed by a receiving jacket which is installed in the ground. In this embodiment of the invention, the central support element serves, on one hand, as a fixing and anchoring element and, on the other hand, as the support element for the plurality of safety deposit boxes. The safe deposit boxes are engaged in close relationship with each other and comprise side-by-side sets of vertically superimposed boxes. Preferably, the boxes are connected by only one singular mounting element to the central support element, so as to prevent a pulling out of the individual safety deposit boxes. Naturally, other constructive measures are feasable for mounting the safe deposit boxes. For example, the safe deposit boxes may be so structured that they form a unitary column which is then mounted at various places on the central mounting element.

This embodiment of the invention is particularly advantageous because it needs relatively few constructive measures at the installation site. For anchoring the column the only prerequisite is a corresponding receiving jacket at the place for anchoring. Naturally, the receiving jacket should be such so as to prevent an unauthorized removal of the column. The anchoring base should preferably be concrete, so that the support element for the safe deposit boxes may be inserted into the receiving jacket. The column can be locked with the receiving jacket with any suitable means. At this point the inventive device is suitable for use.

Preferably, the central support element is a steel pipe having an outer layer of plastic material. At the center portion of this column, the safe deposit boxes are arranged. The receiving jacket and the steel pipe are so arranged that the pipe and the receiving jacket may be positively locked together, and so that the column is only movable (in a non-locked position) in a longitudinal direction of the pipe. Advantageously, the safe deposit boxes are arranged in the center area of the steel pipe, whereby the measurements are such that the safe deposit boxes are easily accessible to the user. It has been found that it is particularly advantageous that the lower end of the safe deposit boxes are 45 cm above the ground surface and the upper end of the safe deposit boxes is about 180 cm from the ground surface. The steel pipe which serves as the support element extends preferably above the end of the safe deposit boxes and may be used as a carrier for facades, as will be explained in detail. As an alternative to the aforementioned embodiment, the safe deposit boxes may be provided in a pipe having a round or multicornered cross-section, with its lower portion serving to anchor the column in the ground. The safe deposit doors are a part of the pipe jacket and are either flat or curved depending on the cross-sectional shape of the pipe. The lower part of the pipe serves for anchoring the column in the ground, and a suitable anchoring jacket may be provided, as above-mentioned, having a correspondingly large enough cross-section for receipt of the lower end of the column. Other suitable embodiments may naturally be used.

In another embodiment, the safe deposit boxes are preferably tapered conically with respect to the center of the column; the safe deposit boxes having a trapezoidal cross-section. The conical shape of the safe deposit boxes permits an optimum use of the inner column space, so that the total space required in this preferable embodiment is drastically less than with an embodiment wherein the safe deposit boxes are rectangular in their cross-section. With such a configuration of the safe deposit boxes, a particularly optimum amount of safe deposit boxes may be arranged. In particular, when a central support element for the safe deposit boxes is provided, conically-tapered safe deposit boxes will be used.

Especially good results will be obtained with the aforementioned structure of the inventive device wherein the column has eight-side faces, the width of which is taken up by a door of the safe deposit box. This embodiment is especially advantageous in conjunction with conically shaped safe deposit boxes and the provision of a central support element.

Depending on the installation site, the inventive device may be provided with corresponding auxiliary equipment. When installing the column in a free open space, the column may be provided with seats at the lower end of the safe deposit boxes. Furthermore, it is advantageous to provide a roof on top of the column which serves as a rain or sun shelter. The central support element serves as the support for the roof which extends over the edge of the safe deposit boxes. In one inventive embodiment, the roof primarily serves as a sun shelter when used at the beach and is therefore in the form of a plastic umbrella. Naturally, other constructive measures are feasible for different application purposes.

Other objects and features of the present invention will become apparent from the following detailed description when taken in connection with the accompanying drawing which discloses one embodiment of the invention. It is to be understood that the drawing is designed for the purpose of illustration only, and is not intended as a definition of the limits and scope of the invention disclosed.

In the following a detailed description is given of the prefered embodiment of the invention in conjunction with the attached drawing.

In the drawing, wherein similar reference numerals denote similar elements throughout the several views.

Figure 1:
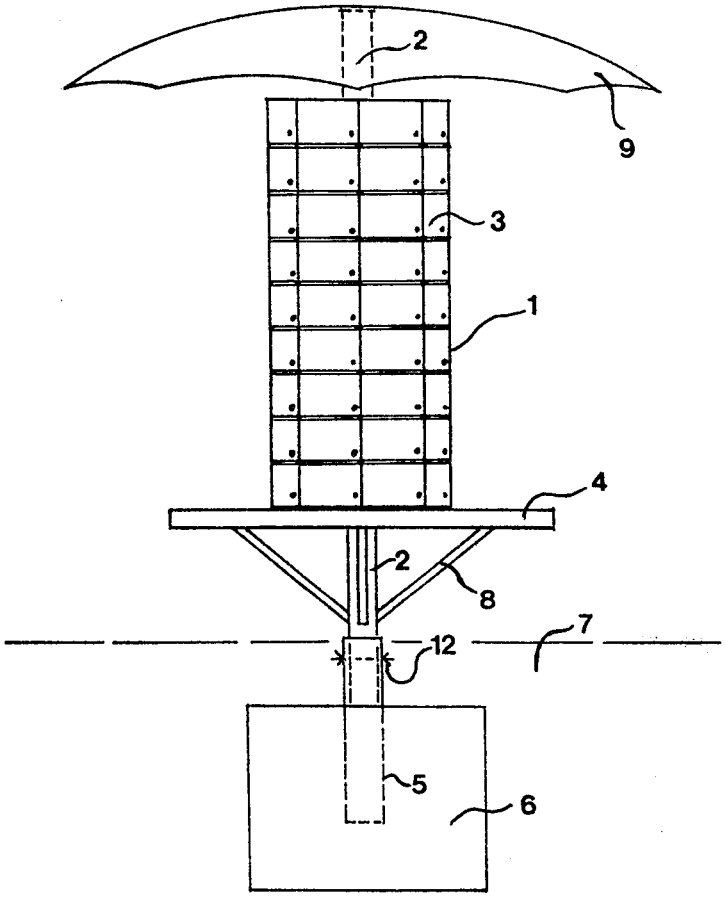
FIG. 1 is a side elevational view of a device for storing valuables embodying the present invention.
Figure 2:
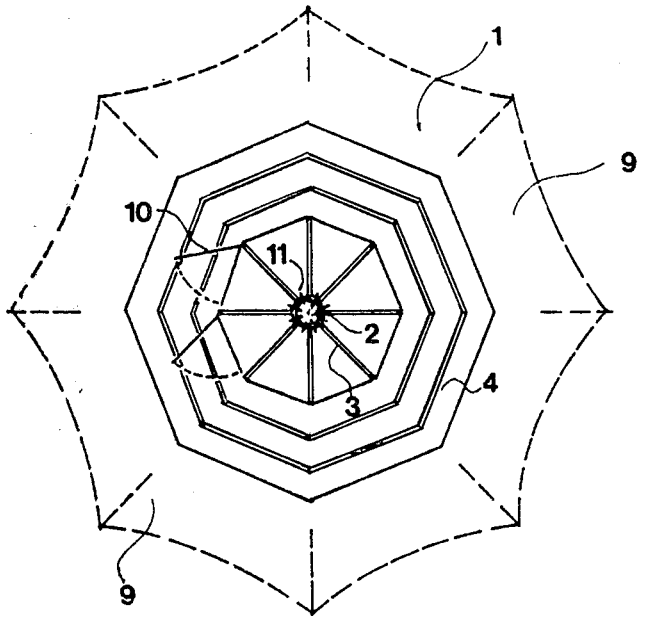
FIG. 2 is a plan view of the device shown in FIG. 1, with the umbrella illustrated partially in phantom line.

FIGS. 1 and 2 show an embodiment of the inventive device for storing valuables which is particularly suited for installation at beaches, in open air swimming pools, or on camping grounds. The embodiment shown in the Figs. essentially consists of a centrally mounted longitudinal support element 2 which is a plastic-coated steel pipe. The support element is about 2.30 m long and is provided with a lower portion which serves as the anchoring means for the support element. An upper portion acts as the support for a roof 9 as well as a center portion around which a plurality of safe deposit boxes 3 are arranged in the form of an octagonal column 1 consisting of side-by-side sets of vertically superimposed boxes 3. As can be seen in FIG. 2, about eight conically shaped safe deposit boxes 3 are arranged in a circle with respect to each other in each row and are mounted with their smaller ends secured to support element 2 by means of suitable retaining or fastening elements 11. This fastening may be effected by the provision of threaded bolts disposed at certain distances spaced apart from each other in the central support element and which are introduced into the back side of conically shaped safe deposit boxes 3 which are provided with corresponding bores to receive the threaded bolts. It is advantageous to cover the threaded bolts so that they cannot be tampered with.

In the illustrated embodiment, wherein the safe deposit boxes form a column having eight side faces, the width of one side face is taken up by a door 10 of a safe deposit box. Hence, in a very comfortable manner adjacent safety deposit boxes may be used without disturbing any other user of an adjacent box. Furthermore, the column-shaped device provides privacy, so that third parties cannot look into the safe deposit box when opened. The illustrated safe deposit box column 1 provides about 72 safe deposit boxes which are arranged in nine vertically superimposed rows having eight safe deposit boxes per row in superimposed arrangement.

In this arrangement, safety deposit boxes 3 are rigidly arranged with respect to each other and support themselves, so that the mounting element 11 is only used to prevent a pulling out of the safe deposit boxes in a horizontal direction. However, this arrangement is only feasable when a suitable support is provided for the lowermost row of safe deposit boxes. In the illustrated embodiment, this support element is in form of a circular plate 4, the annular portion of which extending beyond the safe deposit boxes serves as a seat. The circular plate or seat 4 is welded onto central support element 2 and is also supported by a plurality of angular supports 8, which extend from the central support element 2 to the outer edge of seat 4. The upper end of central support element 2 is provided with a roof 9, which in the shown embodiment is in the shape of an umbrella to provide sun protection.

In order to install the inventive device at a desirable place, it is required that certain preparations be made at the installation site. However, these preparations are in no way expensive and are not comparable with installing the safe deposit boxes in buildings. In the embodiment shown, it merely suffices to provide a receiving jacket 5 in a safe manner in the ground for central support element 2. This is achieved in that jacket 5 is inserted into a concrete base 6. Thereby, the receiving jacket 5 should be such that a locking can take place between the support element and the receiving jacket, so as to prevent as unauthorized removal of support element 2 from receiving jacket 3. FIG. 1 shows schematically a locking element 12 to facilitate this purpose.

After the required preparations are completed, the inventive device may be transported from the place of manufacture to the place of installation and may thus be anchored. Further operations are not required. If it is desirable to remove the safe deposit column from its installation, for example, after the swimming season is over, the locking element is released and the support element 2 is removed from the receiving jacket 5. The column can then be removed and, if need be, reinstalled at a later time.

In order to use the safe deposit boxes in a convenient manner, the lower end of the safe deposit box column is about 45 cm away from the ground, while the upper end is about 180 cm away from the ground. Naturally these measurements are only given as an example and may be changed in accordance with the desired options.

In the illustrated embodiment, the safe deposit boxes preferably have a depth of about 25 cm and a height of about 15 cm. It was found that a glass fiber-reinforced material is particularly suitable for the safe deposit boxes. The safe deposit boxes may be provided with slots to insert coins. The pipe support element may be closed by means of a bushing at its upper end, if the roof of the device is removed.

While only one embodiment of the present invention has been shown and described, it will be obvious to those persons of ordinary skill in the art that many changes and modifications may be made thereunto without departing from the spirit and scope of the invention.

What is claimed is:

1. A device for storing valuables comprising:

a hollow receiving jacket anchored in a ground support;

a multiplicity of safe deposit boxes arranged in a transportable column, said column comprising a plurality of sets of vertically-superimposed deposit boxes, disposed adjacent to one another, said sets being disposed side-by-side in a generally circular arrangement, said column including a centrally-arranged, single support element around which said sets of safe deposit boxes are disposed and to which said sets of safety boxes are rigidly secured, said support element having a lower portion which is receivable and releasably anchorable in said receiving jacket.

2. The device according to claim 1, wherein said support element is a plastic-coated steel pipe, and wherein said safe deposit boxes are mounted on the central portion of said support element.

3. The device according to claim 1, wherein said safe deposit boxes are conically tapered in a direction toward the center of said column.

4. The device according to claim 1, wherein said safe deposit boxes has doors and wherein said column is octagonally-shaped and has eight corner faces, the width of each of which is encompassed up by a door of a safe deposit box.

5. The device according to claim 1, wherein said column is provided with a horizontally-disposed plate abutting the lower end of said column of safe deposit boxes and extending radially outwardly therefrom.

6. The device according to claim 1, additionally including a roof supported above said column of safe deposit boxes.

* * * * *